US007367547B2

(12) United States Patent
Plzak

(10) Patent No.: US 7,367,547 B2
(45) Date of Patent: May 6, 2008

(54) LIFTING DEVICE WITH RELEASE MECHANISM THAT MOVES WITH LIFTED OBJECT

(75) Inventor: Stephen J. Plzak, Pottstown, PA (US)

(73) Assignee: Design Research & Development Corp., Pottstown, PA (US)

( * ) Notice: Subject to any disclaimer, the term of this patent is extended or adjusted under 35 U.S.C. 154(b) by 0 days.

(21) Appl. No.: 11/612,000

(22) Filed: Dec. 18, 2006

(65) Prior Publication Data

US 2007/0181863 A1 Aug. 9, 2007

Related U.S. Application Data

(60) Provisional application No. 60/754,099, filed on Dec. 27, 2005.

(51) Int. Cl.
*B66D 1/36* (2006.01)

(52) U.S. Cl. ..... 254/338

(58) Field of Classification Search ..... 254/335–338, 254/393, 394, 399
See application file for complete search history.

(56) References Cited

U.S. PATENT DOCUMENTS

| | | | | | |
|---|---|---|---|---|---|
| 3,924,751 | A * | 12/1975 | Ballenger | ..... | 211/17 |
| 4,365,834 | A * | 12/1982 | Parkinson et al. | ..... | 254/399 |
| 5,354,035 | A * | 10/1994 | Helgren | ..... | 254/399 |
| 6,056,273 | A * | 5/2000 | Smith | ..... | 254/266 |
| 6,908,074 | B2 * | 6/2005 | Eiwan | ..... | 254/390 |

* cited by examiner

*Primary Examiner*—Emmanuel M Marcelo

(57) ABSTRACT

Provided is a lifting device comprising: a hook or clip; secured to the hook or clip, one or more first pulleys; a second hook or clip; secured to the second hook or clip, (i) a release mechanism comprising a second pulley and a releasable lock for an engaged flexible serpentine article and, optionally, (ii) one or more third pulleys, the second and third pulleys collectively the beta pulleys; and the flexible serpentine article engaged, at a first end, to one or the other hook or clip, and serially engaged through the first pulleys and beta pulleys, to provide a nominal two-fold or greater mechanical advantage, wherein the other end of the serpentine article is last engaged, among above recited elements, by one of the first pulleys.

16 Claims, 9 Drawing Sheets

LIFTING DEVICE WITH RELEASE MECHANISM THAT MOVES WITH LIFTED OBJECT

Provided is a secure system to facilitate the lifting and hanging of objects for storage. More particularly, the present invention provides a versatile method of lifting, suspending, and storing objects from ceilings, joists, studs, or other overhead structures that is simple to install and operate. This device may be used for storing a wide range gear of all sizes and shapes ranging from, but not limited to, canoes, kayaks, bicycles, and ladders. The present invention may be used in most locations where equipment is typically secured during storage including, basements, garages, closets, trucks, boats, RVs, and airplanes.

Commonly found lifting devices (which includes hoists and Block and Tackles) typically require the use of a combination of pulleys, cables, hooks, and cleats and are often difficult to install. Such devices often require precisely positioned installations that are cumbersome and prone to cause interference with otherwise usable workspace near walls and ceilings. The release or lowering mechanism of such hoists is often positioned at or near the top of the device in close proximity to the ceiling from which they are installed thereby putting them out of normal reach of most people without the use of ladders or stools.

To control the lowering of secured objects, variations of such lifting devices use jam cleats or similar mechanisms that are operated by changing the angle of the lifting cable as it exits the pulley arrangement, thereby engaging or disengaging the cable. This method requires the operation of such devices to be from a single location which is generally on one side of the mechanism to provide the necessary clearance for the cable(s) as they pass into the pulley arrangement. Other variations employ the use of a clutch arrangement or ratcheting mechanism to achieve the same purpose. The simplest variations use wall-mounted cleats to secure ends of the load-bearing cables without any self-locking means to prevent accidental release of the cables.

Because of the typical top-mounted positioning of the lowering mechanisms or wall-mounted locations of cleats, lacking in such devices is the ability to guide or walk a secured object slowly down to the floor while maintaining control of the speed at which it is lowered. This inability to control the rate of descent increases the risk of injuries and/or damage caused to secured objects and nearby people and gear. It also makes the vertical alignment, or stacking of multiple objects difficult to achieve by a single operator because a single operator can not operate the lifting mechanism while also handling the object that is being lifted or lowered. The ability to stack multiple objects vertically can be further prevented by an extensive cabling and pulley framework that is often required by the installation of such devices and/or by a requirement that such devices be controlled from a fixed position away from the secured object.

Traditional lifting devices with mechanical advantage require the use of multiple pulleys, bushings, and housings which together provide a path for the lifting/load cable in such a manner as to provide the lifting advantage. Pulleys are used to minimize the friction on the load cable and minimize the adverse affects that friction has on the mechanical advantage. However, with multiple pulley arrangements the amount of friction in the pulley shafts can nonetheless become a significant obstacle to convenient use. To reduce this inherent pulley friction and maximize the mechanical advantage of such devices, the use of costly pulleys with ball bearings or greased bushings is often appropriate for such devices. Pulleys may also include guide rails for keeping the cables on the channeled surface of the pulleys for the purpose of preventing load cable derailment and device failure during operation. The load cable found in such devices is most often rope or wire cable. To minimize the friction in such devices, load cables constructed of rope, wire cable, and chain all require the use of pulleys to minimize friction. Such construction is costly and requires periodic maintenance for safe operation.

A versatile storage system that provides a simple, secure, low-cost, low maintenance and space-efficient alternative is provided by the present invention. Especially when constructed of woven webbing material (strap), self-locking cam buckles, rectangular D-Rings, and snap hooks, the system of the present invention is easily adaptable to efficiently achieve the above objectives while being simple to install and operate.

SUMMARY OF THE INVENTION

Provided is a system for facilitating the lifting and storage of canoes, kayaks, bicycles, and other objects, comprising: hooks for securing each end of the lifting assembly; a load cable and a pulley arrangement that provides a path of mechanical advantage; and a release mechanism that is positioned between the first and last lifting sections of the load cable and provides a secure release mechanism for the lowering of secured objects. The term "cable" is used in the description as a more intuitive alternative to "flexible serpentine article," but here carries the more general meaning of the latter term, which general meaning is reflected in the text below.

A typical pulley system with a mechanical advantage (e.g., lifting hoist or Block and Tackle device) operates by suspending a load by two or more lifting sections of a load cable using a pulley arrangement where each of the lifting sections supports its equal share of the load, thereby reducing the force exerted on it. Through the use of multiple pulleys that are properly positioned, the weight of the load can be distributed among multiple lifting sections, each realizing a fractionally reduced load. As the load cable exits the pulley system after passing beyond the final lifting section of the load cable, the force required from the operator to lift the secured object is equal to the fractionally reduced weight that is exerted on each of the lifting sections in the device. In a theoretical arrangement without any friction caused by the pulley shafts or other forces, the mechanical lifting advantage of such devices can be defined as the total weight of the load divided by the number of lifting sections suspending it. For example, a 100 lb load suspended by four lifting sections in a pulley arrangement would require only require 25 pounds of force to lift. In this example, to provide ten feet of lifting travel, a minimum of 40 feet of cable would be required.

In one embodiment, the cable and pulley arrangement is constructed of woven strap material (the cable) and wire-formed rectangular rings (the pulleys). While rope or cable fails to do so, strap material, including that of thin construction, has a tendency to pass relatively easily around smooth metal round surfaces such as those provided by the post sections of wire-formed rectangular rings without creating a significant source of friction. Therefore the use of strap material in such devices allows for the use of wire-formed rings instead of pulley mechanisms. Such construction not only provides for lower maintenance operation, but also can be produced at a significantly lower cost than that required for the production of cable lifting arrangements with typical pulleys that generally require permanent installation in frames for ideal positioning within the lifting device.

In this embodiment, three wire-formed rectangular rings are fixedly positioned via stitching, bar-tacking, or other suitable methods in a strap arrangement that also includes a fixedly attached self-locking, cam-type buckle for engaging the strap and providing a means for the controlled raising and lowering of a secured object. Further, at each end of the lifting device is a spring-biased snap hook that provides the means for securing a first end of the lifting device strap assembly to an eye bolt, ring, post, or other suitable mounting location, and at the other end, to a kayak, canoe, bicycle, or other object to be secured. Through the use of four lifting sections in each strap assembly and depending upon the amount of friction inherent to both the cam and the wire-formed rectangular rings, such an embodiment would provide a mechanical advantage that approaches 4:1. To secure longer objects including, but not limited to, canoes, kayaks, bicycles, or ladders the use of two strap arrangements would be employed to secure the object at both ends, further distributing the load.

In a variation of the embodiment described above, the use of two wire-formed rectangular rings and a cam release mechanism on each strap arrangement can be used to provide three lifting sections that would provide a mechanical advantage that would approach 3:1. Such a construction would be well suited for lifting lighter loads or to reduce the amount of strap required in a lifting mechanism.

Thus, in one embodiment, provided is a lifting device comprising: a hook or clip; secured to the hook or clip, one or more first pulleys; a second hook or clip; secured to the second hook or clip, (i) a release mechanism comprising a second pulley and a releasable lock for an engaged flexible serpentine article (defined below) and, optionally, (ii) one or more third pulleys, the second and third pulleys collectively the beta pulleys; and the flexible serpentine article engaged, at a first end, to one or the other hook or clip, and serially engaged through the first pulleys and beta pulleys, to provide a nominal two-fold or greater mechanical advantage, wherein the other end of the serpentine article is last engaged, among above recited elements, by one of the first pulleys.

DETAILED DESCRIPTION OF THE INVENTION

The illustrations described below are with respect to devices that use a strap, but other cables can be used.

The present invention provides a method for the simple, secure, reliable, and cost effective lifting and storage of canoes, kayaks, bicycles, and a wide range of other objects that are typically hung during storage. While a single strap assembly can be used to secure shorter or smaller objects, an embodiment consists of two separate strap arrangements (or strap assemblies) that are used to independently lift each end of a secured object.

Figure 1:
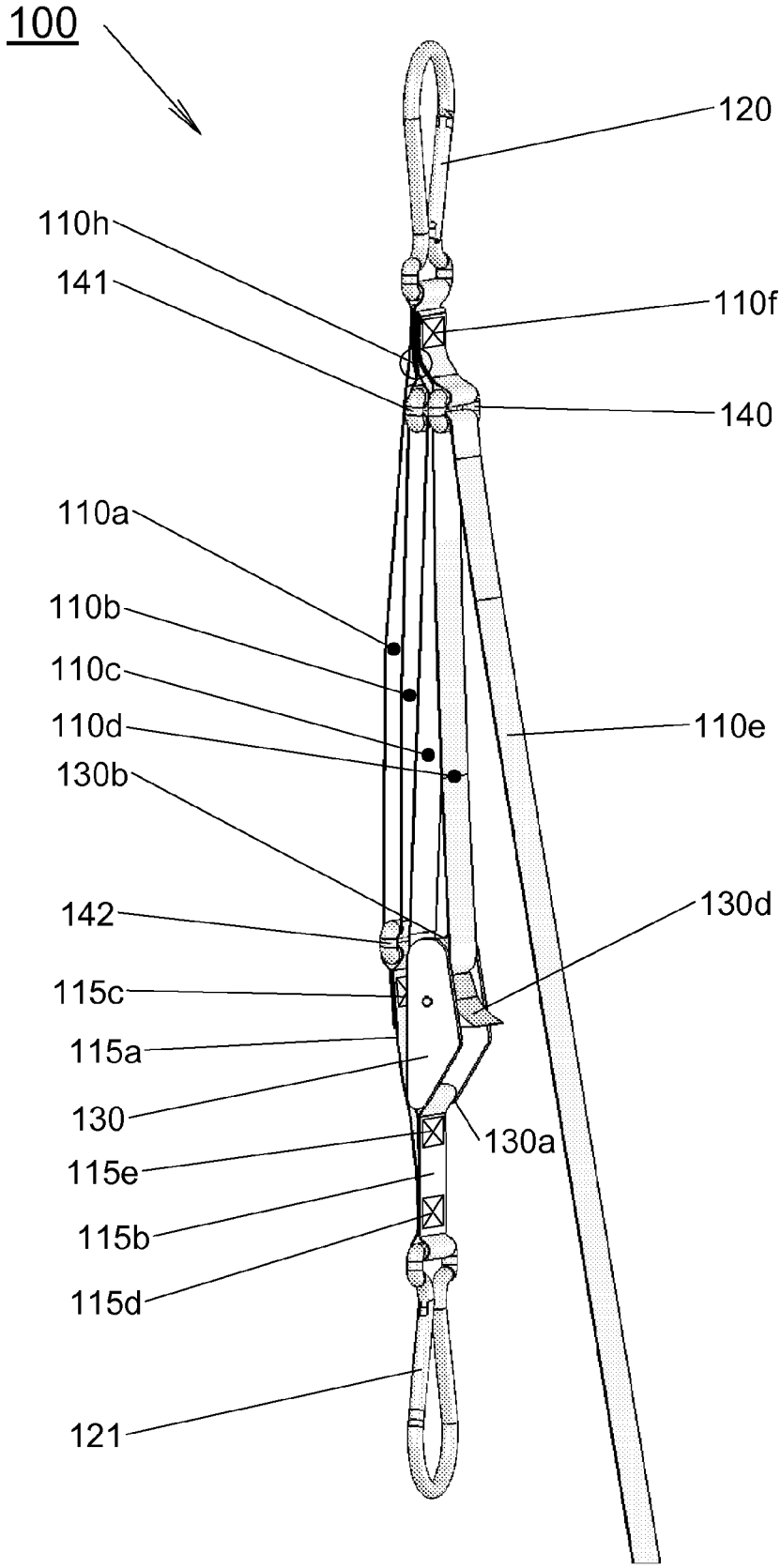
FIG. 1 shows a perspective view of a strap arrangement of the present invention in an embodiment that features four lifting sections.

FIG. 1 shows lifting strap arrangement 100 that provides a nominal 4-fold mechanical advantage via load lifting sections 110*a*, 110*b*, 110*c*, and 110*d* of strap 110. A second strap segment 115B of a first strap 115 is stitched to post 130*a* of release mechanism 130 (which in this case is a spring-biased cam) at box stitch 115*e*. First and second strap segments 115A and 115B are stitched in close proximity to hook 121 (which in this case is a spring-biased snap hook) at stitch 115*d*. First strap segment 115A and terminates at the other end via stitch 115*c* to ring 142 (which in this case is a wire-formed rectangular ring or "squared O-ring"). A fixed end of first strap lifting section 110*a* of second strap 110 is permanently stitched at one end to hook 120 at stitch 110*f*. Strapping segments 110*h* are also engaged by stitch 110*f*, and serve to secure rings 140, 141 to and operationally near hook 120 while also providing spacing (or padding) between rings 140, 141 thereby helping to prevent contact and resulting friction between lifting sections 110*a*, 110*b*, 110*c*, 110*d* during normal operation.

Strap 110 passes downwards from post 120*a* of hook 120 to loop through ring 142, then upwards to loop through ring 141, then downwards to loop around post 130*b* of release mechanism 130, then upwards to loop through ring 140, then downwards. As illustrated, the respective lifting sections between posts or rings are labeled 110*a*, 110*b*, 110*c*, and 110*d*, and the last free section is labeled 110*e*. The length of these sections changes during use in the manner is apparent. ("Upwards" and "downwards" relate to the orientation in the drawings, though in some uses other orientations may be appropriate.)

Positioning of the release mechanism 130 in the lifting strap arrangement 100 between the first load lifting section 110*a* and the last load lifting section 110*d* allows the release mechanism 130 to be positioned in close proximity to the secured object, thereby allowing it to elevate and descend with the secured object, keeping both within reach of the operator during normal operation. This positioning allows for a more controlled lifting and lowering of secured objects. During normal use, pulling the free end of strap section 110*e* downward/away from ring 140 causes the load lifting sections 110*a*, 110*b*, 110*c*, 110*d* to decrease in length while providing shared load support of an object attached to hook 121 when the strap assembly 100 is attached to fixed object (such as a ceiling structure) at hook 120. The total length reductions in load lifting sections 110*a*, 110*b*, 110*c*, 110*d* is approximately equal to an increase in the length of the free end of strap 110*e*. This shortening of load lifting sections 110*a*, 110*b*, 110*c*, 110*d* defines the lifting direction of the strap assembly 100 as the hooks 120, 121 are drawn closer together.

Release mechanism 130 allows strap 110 to slip in the load lifting direction. In the opposite direction, release mechanism 130 requires manual operation for release of loads in the load lowering direction, which is defined by the increasing in lengths of load lifting sections 110*a*, 110*b*, 110*c*,110*d* and decreasing of free end of strap 110*e* as hooks 120, 121 are brought further apart from each other. Such manual operation can be done, for example, by engaging lever 130*d* in direction Z, to rotate cam 130*c* in the releasing direction.

Figure 2A:
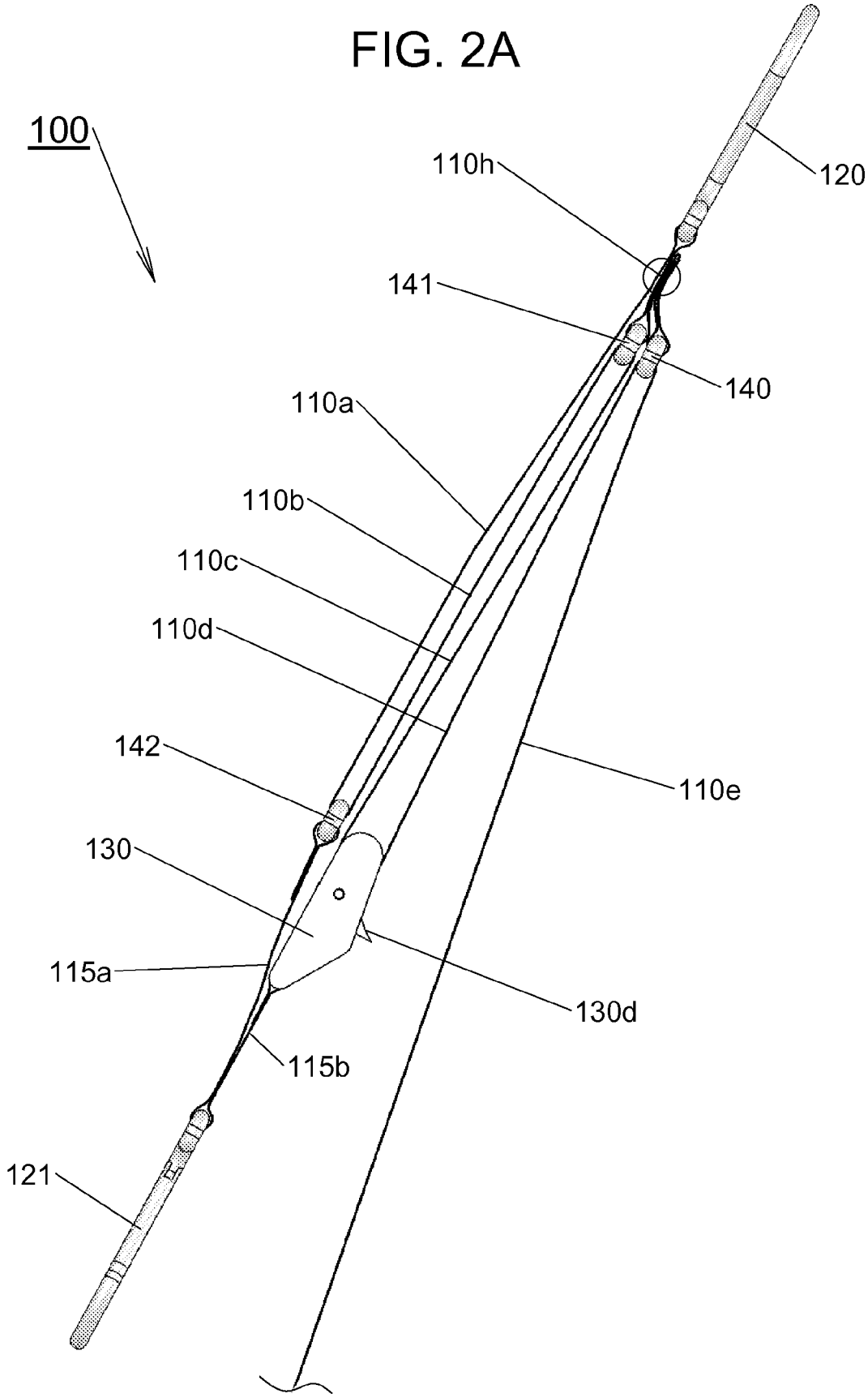
FIG. 2A shows the above strap arrangement of the present invention in a side view that further illustrates a useful cable path.

FIG. 2A shows a side view of the lifting strap arrangement 100 of FIG. 1 that better illustrates the path of the strap 110 around rings 140, 141, 142 and release mechanism 130.

Figure 2B:
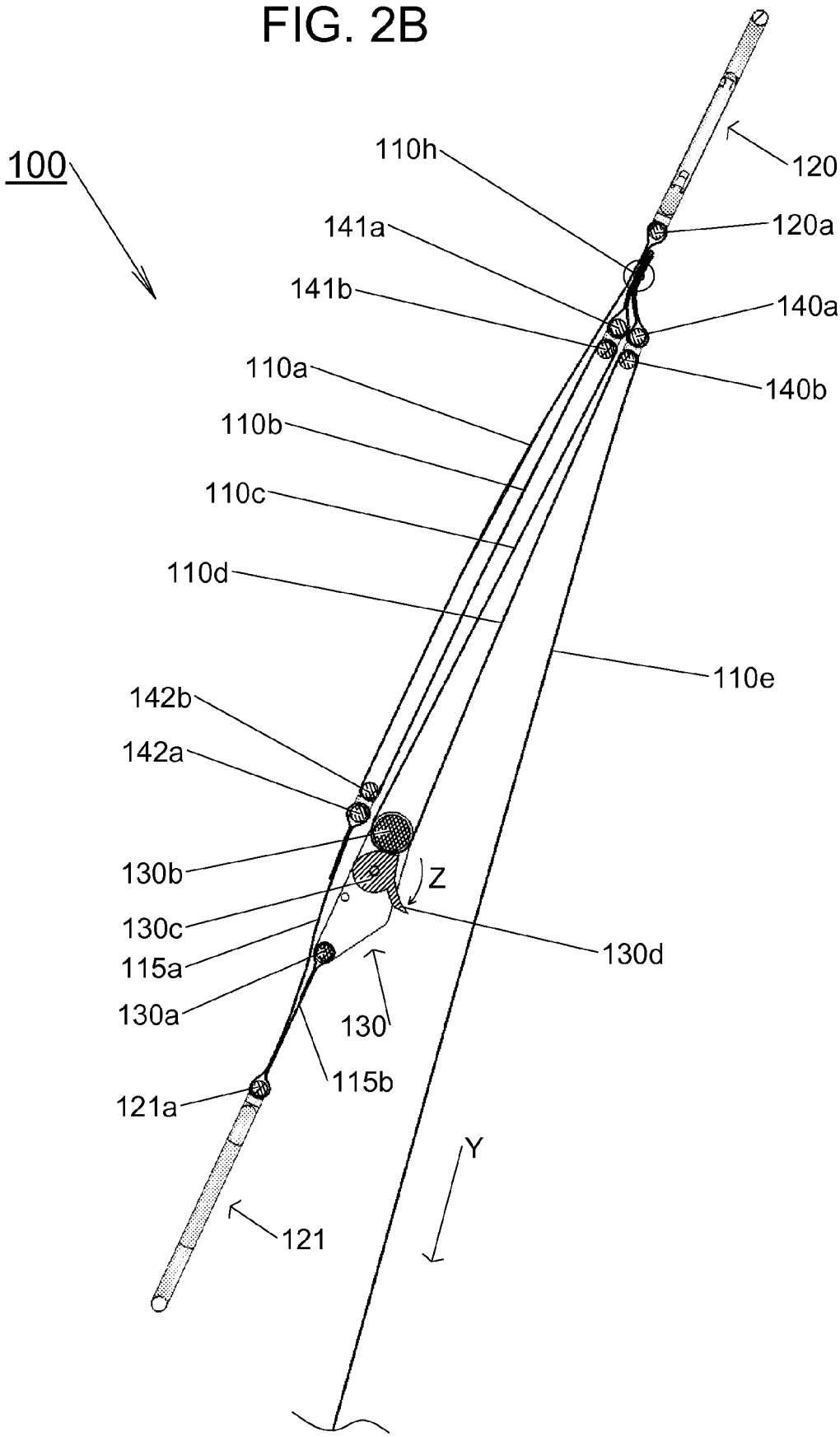
FIG. 2B shows a cross-sectional view of the strap arrangement of FIG. 2A.

FIG. 2B shows a cross sectional view of the lifting strap arrangement 100 of FIG. 1 that adds further detail to the rings 140, 141, 142, release mechanism 130, and hooks 120, 121. In this figure, ring 140 is comprised of two post sections 140*a*, 140*b* that have smooth round surfaces for minimizing the friction inherent to their use in the lifting strap arrangement 100. Similarly rings 141, 142 are comprised of post sections 141*a*, 141*b*, 142*a*, 142*b*. In this embodiment, post sections 140*a*, 141*a* of rings 140, 141 are permanently stitched to strap 110. Release mechanism 130 is further defined by back post 130*a* which is stitched to strap section 115*b*, front post 130*b* which strap 110 passes around, and release button 130*c* which in this case is spring-biased to close in the direction opposite the Z Axis as illustrated. Release mechanism 130 releases its engagement of strap 110 via manually operation of release lever 130*d* of cam 130 in the direction of the Z Axis. Hooks 120, 121 are further defined in this cross-sectional view by hook post sections 120*a*, 121*a* that are adapted to be stitched at each end of the strap lifting arrangement 100 to straps 110, 115. The lifting direction of the strap lifting arrangement 100 is illustrated by pulling the free end of strap section 110*e* in the direction of Y.

Figure 2C:
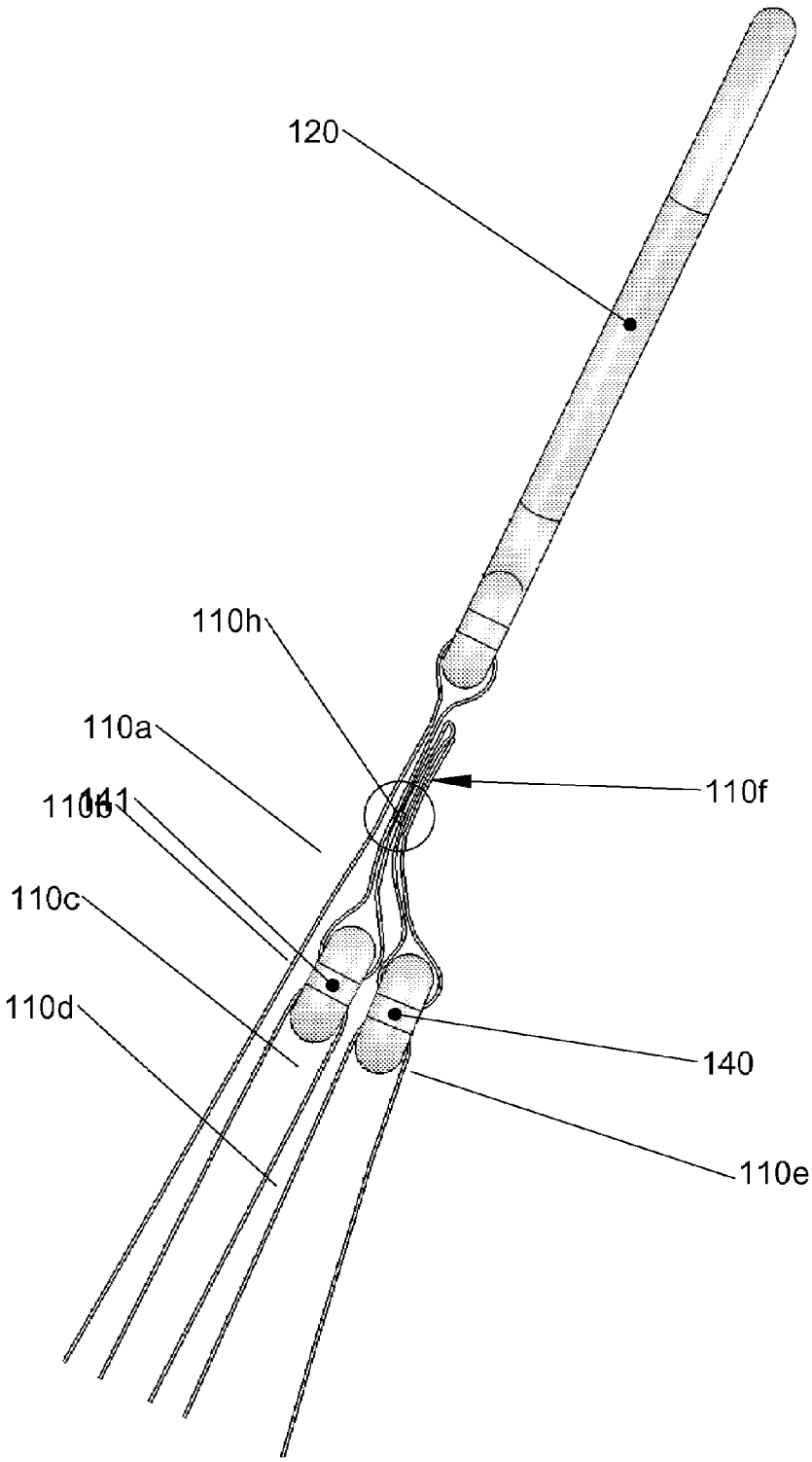
FIGS. 2C and 2D show detail views of each end of the strap arrangement of FIG. 2A.
Figure 2D:
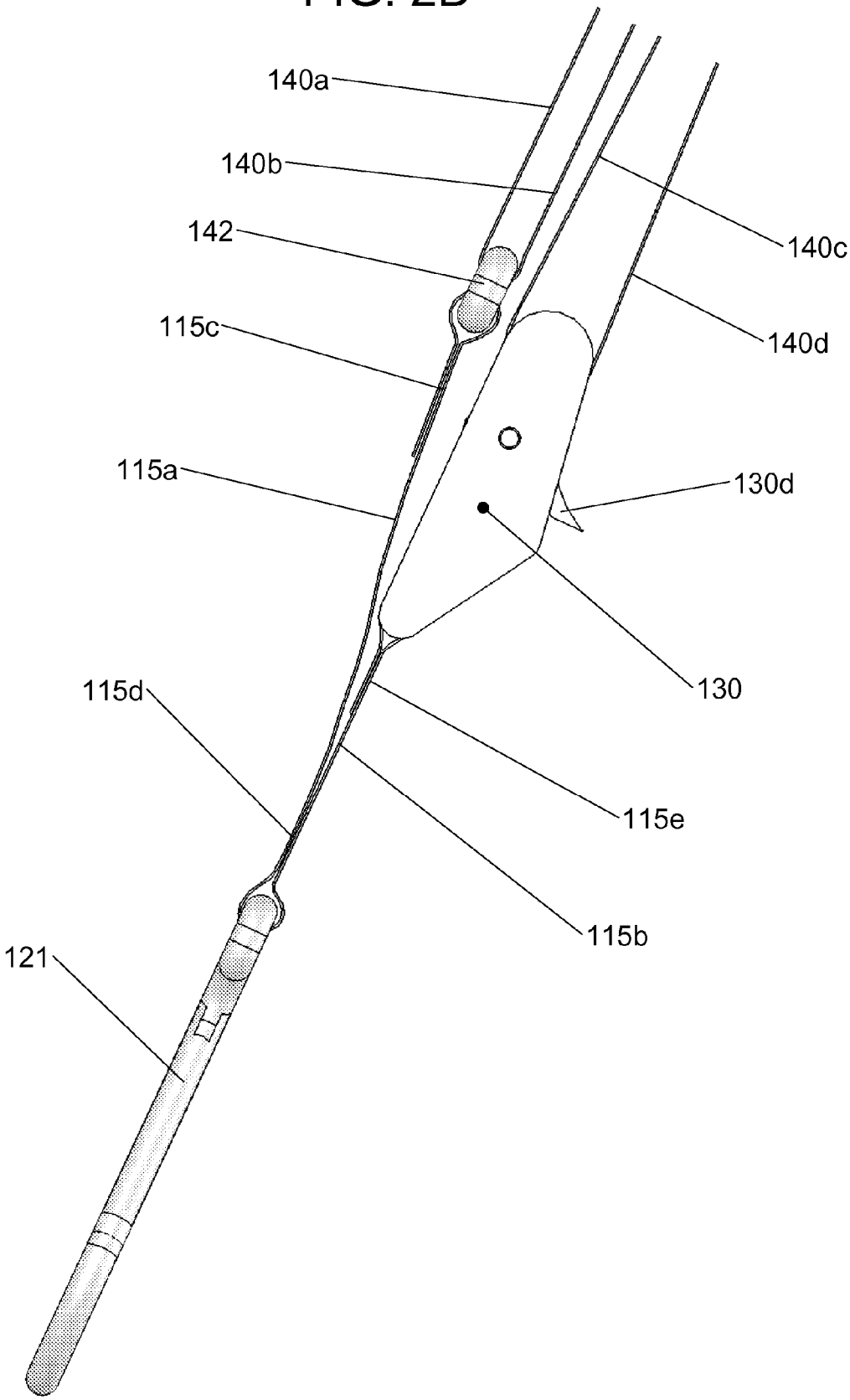

FIG. 2C and FIG. 2D show detail views of the ends of lifting strap arrangement 100 of the earlier figures. One method of folding strap 110 for attachment to hook 120 and rings 140, 141 via stitch 110*f* is shown in FIG. 2C. Similarly FIG. 2D shows a method for the folding and stitching of strap 115 to release mechanism 130, ring 142, and hook 121. It will be apparent to those of ordinary skill in the art that other methods of folding, stacking, and/or stitching may be used to accomplish the same purpose and also to provide separate of lifting segments 110*a*, 110*b*, 110*c*,110*d* and that the invention may be practiced otherwise than as specifically described herein.

Figure 3A:
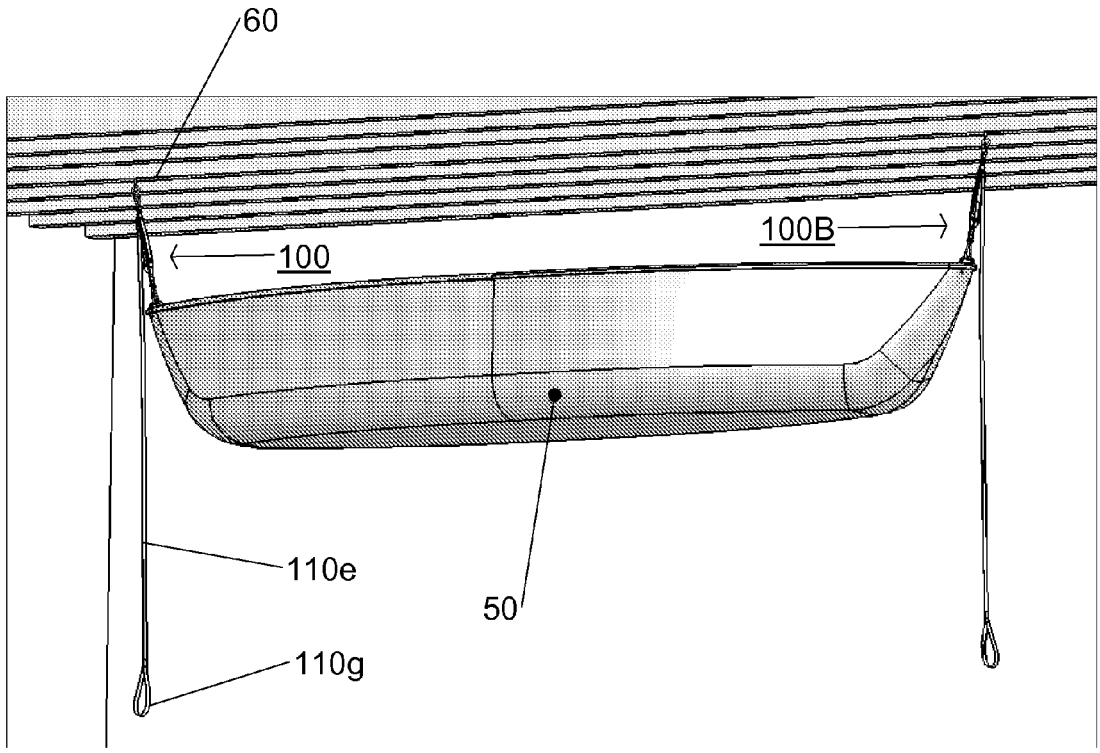
FIG. 3A shows a two strap arrangement of the present invention adapted for use with kayaks or canoes.

FIG. 3A is a perspective view illustrating the invention as adapted for use with lifting a kayak or canoe 50. In this figure, a second lifting strap arrangement 110B is used to secure a second end of an object (in this case canoe 50) from a suitable overhead mounting location (in this case ceiling rafter/joist 60). Further illustrated in this figure is handle 110*g*(in this case a stitched loop of strap) positioned on the free end of strap 110*e*. In this embodiment, handle 110*g* serves not only the purpose of providing a suitable gripping location to the operator during the lifting of strap lifting arrangement 100, but it also helps to prevents the free end of strap 110*e* from passing through ring 140 when the lifting device is fully extended in the process of lowering a secured object. It will be obvious to those of ordinary skill in the art that this feature may also achieved by other methods that may include the use of bulky handles in lieu of the strap looped handle 110*g*, multiple folds and/or stitches that would increase the width of the free end of strap 110*e*, or other methods that would make the tip of the free end of strap 110*e* of larger size than the channel defined by posts 140*a*, 140*b*. The inclusion of handle 110*g* or other suitable method that would prevent the operator from accidentally overextending the distance between hooks 120, 121 helps prevent the reassembly of the strap lifting arrangements 100, 100B in the event of overextension of the strap lifting arrangement 100.

Figure 3B:
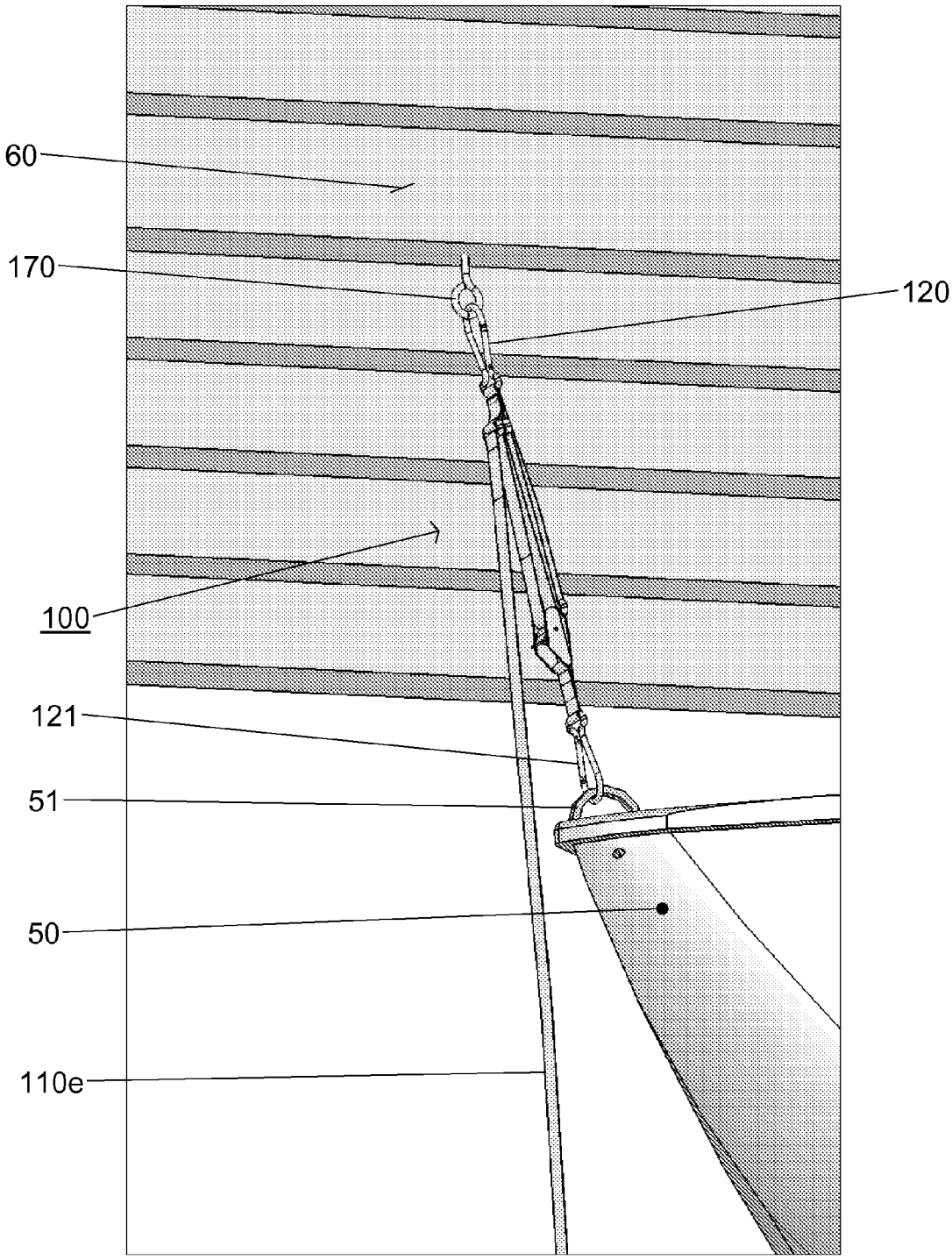
FIG. 3B shows a detail view of how a strap arrangement may secure the canoe or kayak of FIG. 3A to a mounted lag eye bolt in a ceiling rafter or joist.

FIG. 3B is a detailed view of the strap lifting arrangement 100 of FIG. 3A adapted for use with a kayak or canoe 50. Shown in this figure on the top surface of the bow of the canoe 50 is eye ring 51 that is engaged by hook 121. On the other end of lifting strap arrangement 100, hook 120 engages threaded lag eye bolt 170 that is threaded into ceiling rafter/joist 60. Kayaks, canoes, or other objects that do not have integrated eye ring 51 may be secured by lanyard ropes or the like.

Strap lifting arrangement 100 can alternatively be indirectly connected to a supported canoe or kayak via the eyes, rings, or loops of straps or pads that can be passed around the hull of a kayak or canoe (for example) thereby forming a cradle to distribute the load more evenly and prevent hull deformation that may occur during extended storage periods. Such hull cradle arrangements serve to provide useful methods for the storage of plastic or wooden canoes and kayaks, which are especially vulnerable to hull deformation when supported exclusively from grab handles, lanyards, or rings on or near their ends. In one embodiment, the hull cradle arrangement includes an additional, adjustable section of strap that provides a means for joining adjacent hull cradle straps, thereby maintaining a maximum distance between the hull cradle straps. So holding the cradle straps helps to prevent them from slipping off the ends of the canoe or kayak during storage while also allowing for the rotation of secured kayaks or canoes in the cradle. Further, the rotation of kayaks or canoes in the cradle arrangement provides a useful means for cradled storage of kayak hulls, which is favorably sideways, and also allows for the upside-down storage of canoes.

Figure 4A:
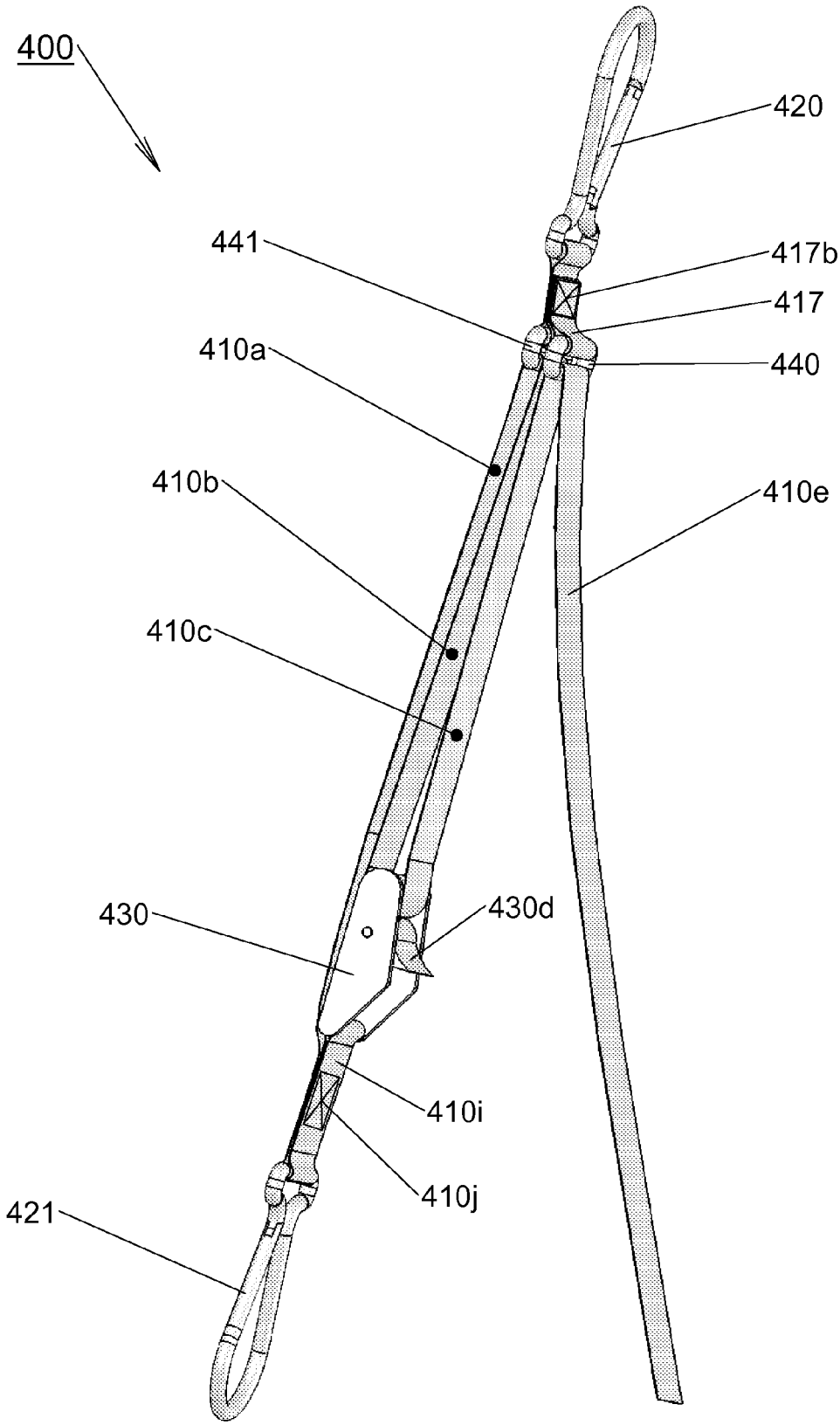
FIG. 4A shows an embodiment that uses three lifting sections.
Figure 4B:
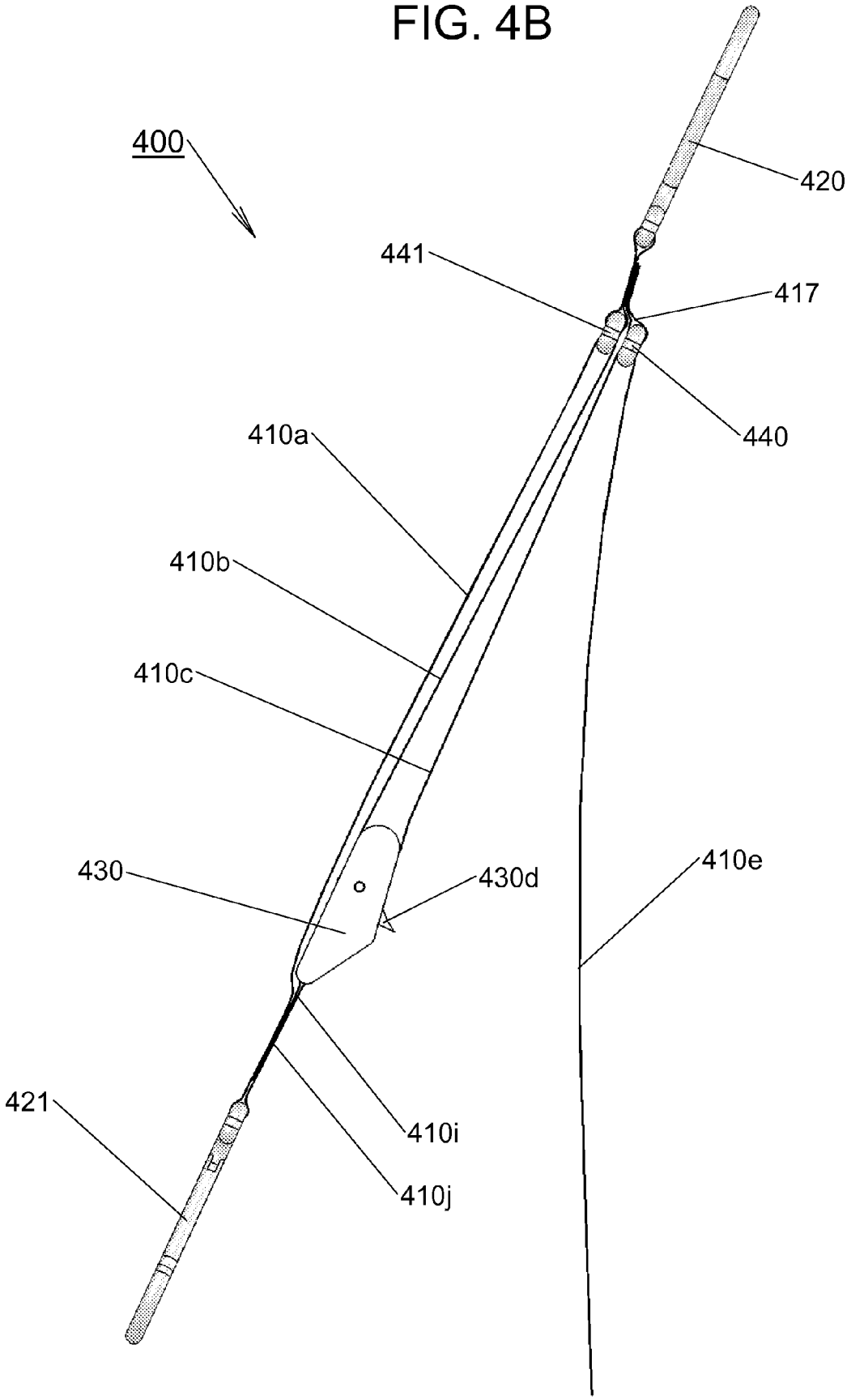
FIG. 4B shows a side view of the embodiment of FIG. 4A that further illustrates a useful cable path of such an arrangement.

FIG. 4A and FIG. 4B show an embodiment of the present invention that includes three load lifting sections 410*a*, 410*b*, 410*c* and release mechanism 430 to provide a lifting strap arrangement 400 with a mechanical advantage that approaches 3:1. In this embodiment, strap 410 is secured near strap section 410*i* to release mechanism 430 and hook 421 via stitch 410*j* before extending to ring 441 (defining a first load lifting section 410*a*), back to the front post section of release mechanism 430 (defining a second load lifting section 410*b*), around to ring 440 (defining a third and last load lifting section 410*c*), and exiting as free end of strap 410*e*. Further illustrated in this sketch is strap 417 which is stitched at 417*b* to secure ring 420 to rings 440, 441. While providing less of a mechanical advantage than the embodiments in the earlier figures, the operation of this embodiment is substantially the same as described earlier.

The release mechanism, such as release mechanism 130, can be usefully sized and shaped so that it can be grasped with one hand, and lever 130*d* operated with, for example, the thumb of that hand. It has been found that with 3-fold or 4-fold mechanical advantage, a 80 lb. kayak can lowered just by operating the release mechanism with one hand.

The pulleys used with this device can conveniently be rings adapted for use with straps, such as rings shaped to orient the straps and provide posts with smooth surfaces on which the straps may slide. However, some embodiments use any pulley device.

When rings, such as the rectangular rings illustrated in the drawings, used with straps, the folding and stitching used to secure non-pulley end of the ring can provide bulk that maintains separation between the pulleys, limiting a possible extra source of friction from sections of strap rubbing as they pass through adjacent pulleys. Extra folds and stitching in the securing strap can be used to enhance such separation if desired.

The pulleys at one end of the device (e.g., the first pulleys) and/or the pulleys at the other end of the device (e.g., the beta pulleys), can be secured in a housing. For the end of the device with the release mechanism, generally the release mechanism will be in the housing with its associated pulley. Such a housing can take many forms, as will be apparent to those of ordinary skill in the art. For example, it can take the form of two pieces (for example, arrayed in parallel) of relatively rigid material, such as metal or high impact plastic. Mechanical linkages, which can include the structure of the pulleys, can maintain separation of the sheets. If, for example, the pulleys comprise posts adapted to facilitate straps sliding across them, then the housing can frame just the posts, without the ring structure illustrated. Optionally, with such posts, the linkage with the housing may also allow rotation, providing another reduction in friction.

Release mechanisms adaptable for use with the lifting device include, for example: (i) a spring-biased cam (e.g., metal, high impact plastic) such as often found in tie-down straps, (ii) a pendulum-activated, over center tripping device such as found in U.S. Pat. No. 6,295,700. Other mechanisms include, for example, a ratcheted pulley design. Such a ratcheted design allows the pulley to rotate in one direction without engaging the ratchet arm, but requires the depression of a lever to disengage the ratchet teeth in the other direction. Such ratcheted devices can use spring biased levers as the ratchet arm and they are widely used with rope pulley tie down products.

A "nominal" 2-fold or greater mechanical advantage refers to the theoretical advantage, discounting the effects of gravity or friction.

A "hook or clip" refers to innumerable known or similar devices that attach to an appropriate receptacle by threading, looping, clipping, or the like. Hooks or clips include, for example, loops of serpentine article.

A "flexible serpentine article" refers to innumerable known or similar articles that can be flexibly bent, can be drawn with a useful amount of force, and can be drawn through a pulley. Flexible serpentine articles include, for example, ropes, chains, cords, cables, straps, and the like.

While this invention has been described with an emphasis upon preferred embodiments, it will be obvious to those of ordinary skill in the art that variations in the preferred devices and methods may be used and that it is intended that the invention may be practiced otherwise than as specifically described herein. Accordingly, this invention includes all modifications encompassed within the spirit and scope of the invention as defined by the claims that follow.

What is claimed:

1. A lifting device comprising:

a hook or clip;

secured to the hook or clip, at least one first pulley;

a second hook or clip;

secured to the second hook or clip, at least one beta pulley, one of which comprising a release mechanism comprised of a said beta pulley and a releasable lock for an engaged flexible serpentine article; and the flexible serpentine article engaged, at a first end, to one or the other hook or clip, and serially engaged through the first pulleys and beta pulleys, to provide a nominal two-fold or greater mechanical advantage, wherein the other end of the serpentine article is last engaged, among above recited elements, by one of the first pulleys.

2. The lifting device of claim 1, wherein a penultimate engagement of the serpentine article, among above recited elements, is with the beta pulley comprising the release mechanism.

3. The lifting device of claim 1, wherein the serpentine article is a strap.

4. The lifting device of claim 3, wherein at least one pulley comprises a post against which the strap can slide.

5. The lifting device of claim 4, wherein the post is comprised within a squared O-ring.

6. The lifting device of claim 1, wherein the serpentine article can move through the beta pulley having the release mechanism irrespective of the release mechanism when moving in a direction that moves the second hook or clip closer to the first, but where the release mechanism must be engaged for movement in reverse.

7. The lifting device of claim 6, wherein the release mechanism comprises a spring-biased cam.

8. The lifting device of claim 1, wherein the flexible serpentine article is engaged, at the first end, to the first hook or clip and through an alternating sequence of (i) a said beta pulley, (ii) a said first pulley, and (iii), if there are further beta pulley(s) and first pulley(s), further beta pulley to first pulley interation(s), wherein such iterations end with a said first pulley, to provide a nominal two-fold or greater mechanical advantage.

9. The lifting device of claim 8, wherein the serpentine article is a strap.

10. The lifting device of claim 9, wherein at least one of the pulleys comprises a post against which the strap can slide.

11. The lifting device of claim 10, wherein the post is comprised within a squared O-ring.

12. The lifting device of claim 1, wherein the flexible serpentine article is engaged, at the first end, to the second hook or clip and through an alternating sequence of(i) a said first pulley, (ii) a beta first pulley, (iii), if there are further first pulley(s) and beta pulley(s), further first pulley to beta pulley interation(s), wherein such iterations end with a said beta pulley, and (iv) a said first pulley to provide a nominal three-fold or greater mechanical advantage.

13. The lifting device of claim 12, wherein the serpentine article is a strap.

14. The lifting device of claim 13, wherein at least one of the pulleys comprises a post against which the strap can slide.

15. The lifting device of claim 14, wherein post is comprised within a squared O-ring.

16. A method of lifting or lowering comprising:

providing at least one first pulley secured to a fixed object;

providing a movable object secured to at least one beta pulley, one of which comprising a release mechanism comprised of a said beta pulley and a releasable lock for an engaged flexible serpentine article;

providing the flexible serpentine article engaged, at a first end, to one or the other object, and serially engaged through the first pulleys and beta pulleys, to provide a nominal two-fold or greater mechanical advantage, wherein the other end of the serpentine article is last engaged, among above recited elements, by one of the first pulleys; and drawing on the other end of the serpentine article to lift the movable object, or controllably activating the releasable lock to controllably lower the movable object.

* * * * *